US005918672A

United States Patent [19]

McConnell et al.

[11] Patent Number: 5,918,672

[45] Date of Patent: Jul. 6, 1999

[54] SHROUD FOR A WELL SCREEN

[76] Inventors: Howard T. McConnell, 6043 Spring Creek La.; Robert D. Whitworth, 7114 Huntbrook, both of Spring, Tex. 77379

[21] Appl. No.: 08/853,019

[22] Filed: May 8, 1997

[51] Int. Cl.[6] ..... E03B 3/18

[52] U.S. Cl. ..... 166/233

[58] Field of Search ..... 166/205, 227, 166/231, 233, 234

[56] References Cited

U.S. PATENT DOCUMENTS

| | | | |
|---|---|---|---|
| 3,908,256 | 9/1975 | Smith | 166/233 X |
| 5,476,143 | 12/1995 | Sparlin et al. | 166/233 |
| 5,611,399 | 3/1997 | Richard et al. | 166/230 |

FOREIGN PATENT DOCUMENTS

| | | | |
|---|---|---|---|
| 2320042 | 6/1998 | United Kingdom | E21B 43/08 |

OTHER PUBLICATIONS

Baker–Hughes brochure entitled "The Excluder™", 3 pgs. (undated).

*Primary Examiner*—Roger Schoeppel

[57] ABSTRACT

A well screen is disclosed for positioning in a well bore to screen solid particles from the fluid produced by the well including a perforated base pipe having threaded connections for connecting the base pipe into a pipe string and a wire screen surrounding the perforations of the base pipe, a tubular shroud covers the screen and provides an annulus between the shroud and the screen, the shroud having a plurality of round holes through which well fluid can flow into the annulus, a plurality of arcuate straps located in the annulus with the ends of each strap attached to the shroud on opposite sides of one of the holes in the shroud to cause the well fluid flowing through the holes to swirl as it passes through the holes and to flow laterally from each side of the straps into the annulus between the shroud and the screen.

5 Claims, 2 Drawing Sheets

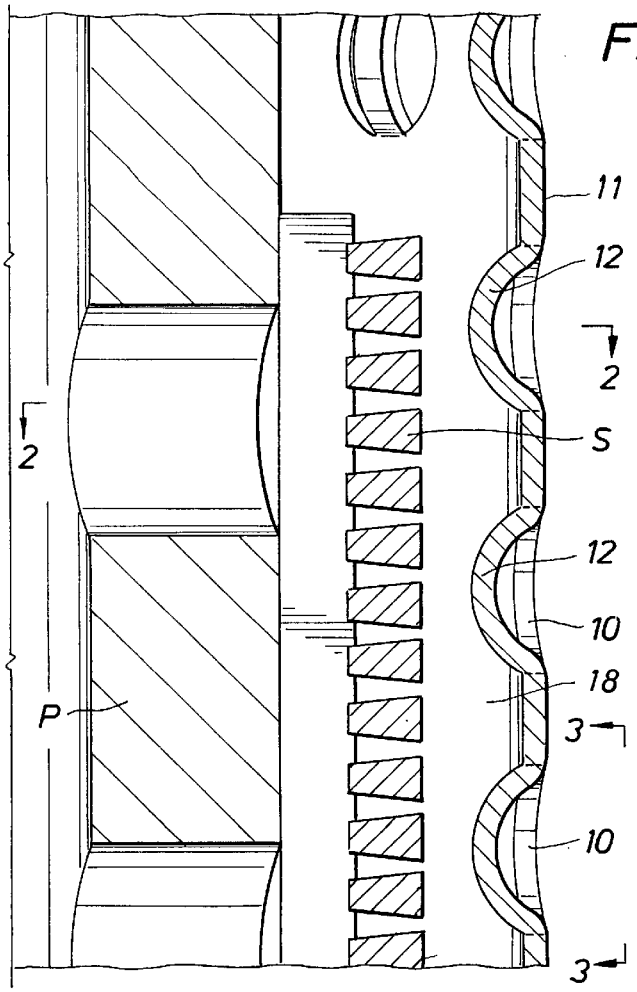
FIG. 1
FIG. 4
(PRIOR ART)
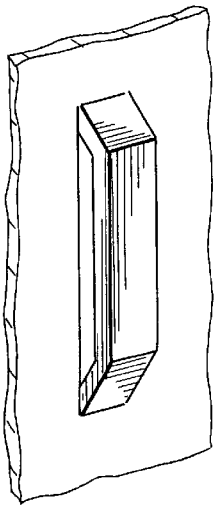
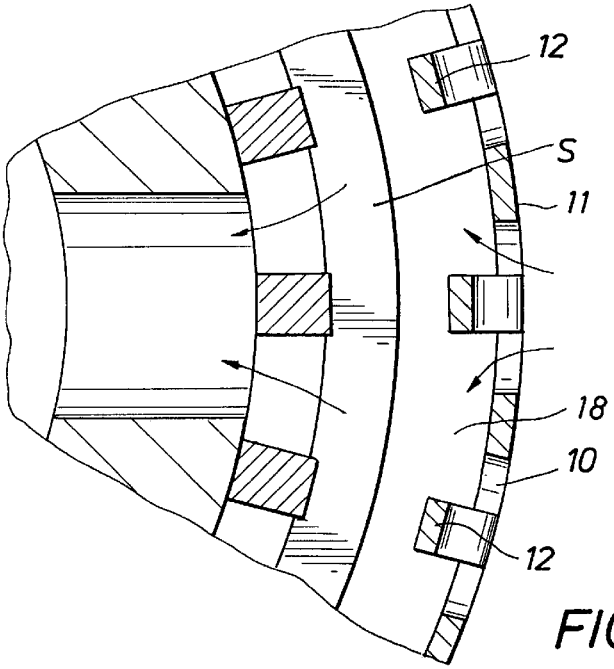
FIG. 2
FIG. 3
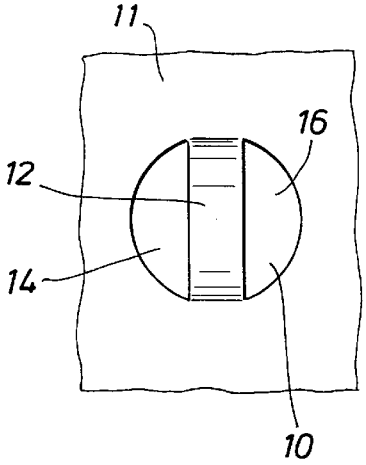

SHROUD FOR A WELL SCREEN

This invention relates to well screens generally, and in particular, to shrouds that are a common part of a well screen assembly. Shrouds are used to protect the screens that actually filter the solid particles, such as sand, from the fluid being produced by an oil and/or gas well. Shrouds also keep the screens from being damaged as the well screen assembly is being connected in a production pipe string and as it runs into the well bore of an oil or gas well. Shrouds also serve to connect the screen in the production string.

Heretofore, shrouds were simply pipe joints having perforated walls. This allowed the well fluid and any entrained solids to flow through the perforations and impinge directly on the inner well screen. In high production wells and particularly a well producing a substantial amount of gas with entrained sand, the entrained sand could cut through a well screen in a short period of time.

It is an object of this invention to provide a shroud for a well screen with specially designed openings that cause the well fluid flowing through the openings to form a vortex in the opening so that the fluid enters the annulus between the shroud and the screen in a direction generally parallel to the annulus thereby reducing substantially the tendency of the fluid to erode or cut away the screen.

It is another object and feature of this invention to provide a shroud for a well screen having cylindrical perforations in the wall of the shroud with a convex portion of the metal of the shroud extending into the anunlus between the shroud and the screen that combines with the circular configuration of the perforation to enhance the swirling motion of the fluid as it passes through the perforation into the annulus between the shroud and the well screen. As stated above, heretofore most well screen shrouds were simply perforated pipe joints having cylindrical perforations through which the fluid flowed at a perpendicular angle to the longitudinal axis of the screen and impinged directly on the screen. Baker-Hughes has now marketed a shroud (shown in FIG. 4), in which the well fluid passes through a rectangular opening in the screen proper at an angle perpendicular to the longitudinal axis of the screen and impinges on a flat wall positioned across the outlet to the perforation that to deflect the flow 90° so that the fluid enters the annular space between the shroud and the well screen along a line generally parallel to the longitudinal axis of the screen. In this arrangement, the flat deflecting wall suffers the erosion.

These and other objects, features, and advantages of the invention will be apparent to those skilled in the art from this specification, including the attached drawings and appended claims.

IN THE DRAWINGS:

FIG. 1 is a sectional view of the well screen of this invention showing a portion of perforated pipe mandrel P, wire wrapped screen S, and shroud 11;

FIG. 2 is a sectional view on an enlarged scale taken along line 2—2.

FIG. 3 is a view taken along line 3—3 of one of the openings in the shroud.

FIG. 4 is a sectional view of the Baker-Hughes screen.

The flow pattern produced by the shroud of this invention is based upon a circular configuration in three dimensions. Basically the fluid enters cylindrical openings 10 in the shroud in a helical fashion and upon contact with the concave surface of straps 12 positioned directly below and across the center of the opening, the circular helical flow of the fluid is enhanced so that the fluid enters annulus 18 between the shroud and the well screen in a circular flow pattern generally parallel to the longitudinal axis of the screen, which will cause the fluid to flow into annulus 18 generally parallel to the outer surface of the well screen. From a physics standpoint, this is a much more efficient flow pattern than a perpendicular angle and it also protects the screen from being damaged by any solid particles carried by the well fluid hitting the screen directly. As a result, erosion of the screen is decreased.

The flow pattern of this invention is based on a circular configuration in three dimensions. The flow vector enters the perforations in the shroud flowing in a helical fashion that is enhanced upon contact with the rounded or concave solid center straps 12.

A strict definition of FLOW is the amount of the physical quantity transported in unit time through a unit area perpendicular to the direction of flow. It is proportional to the gradient of other physical properties, i.e., temperature, gravity, pressure, etc. Mathematically the term "zx" will be used as the direction of flow. Since flow occurs in a particular direction, it is a vector quantity.

Figure 5:
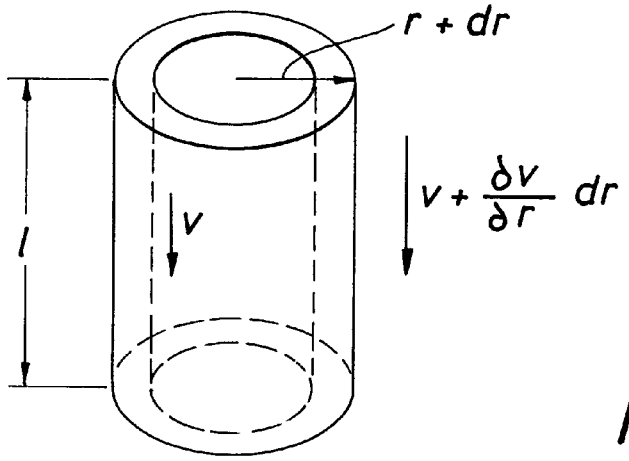
FIG. 5 is a schematic diagram of the components of Poiseuille's Law.
Figure 6:
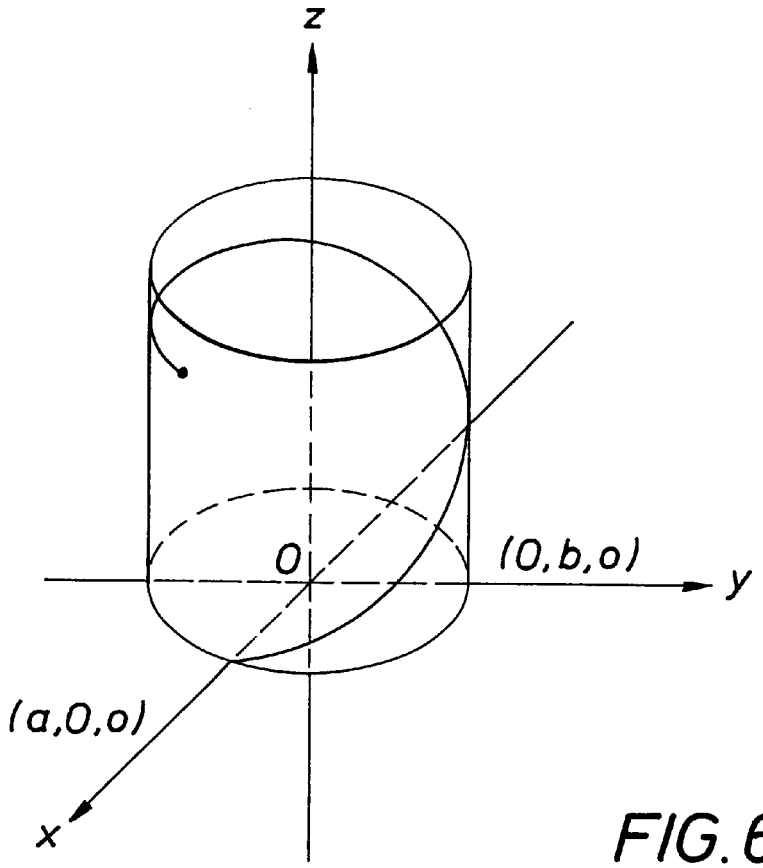
FIG. 6 is a schematic diagram of the terms for calculating velocity and acceleration of the circular motion.

The rate at which a fluid flows through a tube or a cylindrical opening depends on the dimensions, radius and length of the tube, the viscosity of the fluid, and the pressure drop between the ends of the tube. The following are the mathematical propositions for proving the direction of flow of the fluid through the perforations of this invention as shown in FIG. 5. They include the Poiseuille formula. Also used is the arc length curvature in three dimensional vectors to prove the circular flow.

1. GENERAL LAW $$J_z = -B\frac{\delta Y}{\delta z}$$

$J_z$=Flow (per $CM^3$ per sec)

−B=Proportionality Constant $$\frac{\delta Y}{\delta z} = \text{The Gradient of } Y \text{ in the Direction of Flow}$$

Y=Quantities of Physical Parameters

2. POISEUILLE'S LAW (FLUID FLOW) (used for flow calculation for hole through the wall of shroud)

$$J_z = -C\frac{\delta p}{\delta z}$$

$J_z$=Flow (per $cm^3$ per sec)

−C=Proportionality Constant $$\frac{\delta p}{\delta z} = \text{Pressure and Flow Gradient}$$

Poiseuille's Law for Detailed Computation of Parameters $$V = \int_o^a 2\pi rvdr = \text{Total Volume Passing any Point in Unit Time}$$

$$f_x = (P_1 - P_2)2\pi rdr = \text{Net Force} + x \text{ Direction}$$

-continued $$nS\frac{\delta v}{\delta r} + d\left(nS\frac{\delta v}{\delta r}\right) = \text{Force in } x \text{ Direction on Outer Surface}$$

$$f'x = d\left(nS\frac{\delta v}{\delta r}\right) = \text{Net Viscous Force in Sum of Forces on Inner and Outer Surfaces}$$

Incorporating these detailed equations and doing the math we obtain:

$$V = \frac{\pi(p_1 - p_2)}{2nl}\int_o^a (a^2 - r^2)rdr = \frac{\pi a^4(p_1 - p_2)}{8nl}$$

which is also Poiseuille's formula or if:

a<1 calculate n from the measured volume of liquid discharged in unit time.

Since Pressure Gradient:

$$\frac{\delta p}{\delta x} = \frac{(p_2 - p_1)}{l}$$

Change Form to:

$$V = \frac{\pi a^4}{8_n}\frac{\delta p}{\delta x}$$

which is also Poiseuille's Formula.

3. VELOCITY AND ACCELERATION (Circular Motion)

Instantaneous Velocity=v(t)=r'(t) t=time

Acceleration=a(t)=v'(t)=r"t $$\text{Magnitude of Velocity} = |v(t)| = \sqrt{[f'(t)]^2 + [g'(t)]^2 + [h'(t)]}$$

Velocity Vector (Moving Point P, Time t)=v(t)=−a sin ti−b cos tj+k

Arc Length Curvature of Circular Helix at Time t Curvature=K $$K(t) = \left|\frac{T^1(t)}{|v(t)|}\right| = \left|\frac{-\cos t}{\sqrt{2}}i\frac{\sin t}{\sqrt{2}}j\right|$$

4. OPEN AREA (On Shroud Manufactured)

$$\text{Stamp Area} = \frac{D^2C}{(S)^2}$$

For example:

Where

D=0.3125 in.

C=90.69 (a constant of unknown origin)

S=distance between centers, in.

$$= \frac{[(.3125)(.3125)](90.69)}{[(.5)(.5)]}$$

$$= 35.4 \text{ in}^2$$

-continued $$\text{Open Area} = (\text{Stamp Area})(\text{Stamp Open Area}) = (35.4)(.574) = 20.3\%$$

.574 = Per Drawing

As shown in the drawings, the forming of the strap 12 creates lateral openings 14 and 16 through which fluid flows into the shroud and longitudinally in the annulus between the shroud and the well screen. The fluid inherently circulates in a circular direction because of the coriolis force combined with the flow retarding effect of the concave strap extending across the bottom of the opening.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. In a well screen for positioning in a well bore to screen solid particles from the fluid produced by the well including a perforated base pipe having threaded connections for connecting the base pipe into a pipe string and a wire screen surrounding the perforations of the base pipe, the improvement comprising a tubular shroud covering the screen and providing an annulus between the shroud and the screen, said shroud having a plurality of round holes through which well fluid can flow into the annulus, a plurality of arcuate straps located in the annulus with each strap having a width less than the diameter of the holes with the ends of each strap attached to the shroud on opposite sides of one of the holes in the shroud and extending into the annulus between the shroud and the screen to cause the well fluid flowing through the holes to swirl as it passes through the holes and flows laterally from each side of the straps into the annulus between the shroud and the screen.

2. The well screen of claim 1 in which the wire screen contains longitudinally extending support rods.

3. A shroud for covering a well screen and providing an annulus between the shroud and the screen comprising a tubular member having a plurality of circular openings in its wall through which well fluid can flow into the shroud and a plurality of curved straps each of which is connected at each end to opposite sides of one of the openings to provide concave surfaces against which fluid flowing through the openings into the annulus flows to combine with the circular opening and cause the fluid to swirl as it flows through the openings and laterally into the annulus.

4. The shroud of claim 1 in which the straps are of uniform width.

5. The shroud of claim 3 or 4 in which the straps are one-half of a ring.

* * * * *

UNITED STATES PATENT AND TRADEMARK OFFICE

CERTIFICATE OF CORRECTION

PATENT NO. : 5,918,672

DATED : July 6, 1999

INVENTOR(S) : Howard T. McConnell and Robert D. Whitworth

It is certified that error appears in the above-indentified patent and that said Letters Patent is hereby corrected as shown below:

In column 1, line 41, delete the word "to" and change "deflect" to "deflects".

Signed and Sealed this

Twenty-third Day of November, 1999

*Attest:*

Q. TODD DICKINSON

*Attesting Officer*

*Acting Commissioner of Patents and Trademarks*